US006641369B2

(12) United States Patent
Cavatorta

(10) Patent No.: US 6,641,369 B2
(45) Date of Patent: Nov. 4, 2003

(54) LIQUID RING COMPRESSOR WITH THIN DISTRIBUTION PLATE

(75) Inventor: Paol Cavatorta, Parma (IT)

(73) Assignee: Robuschi & C. S.p.A., Parma (IT)

( * ) Notice: Subject to any disclaimer, the term of this patent is extended or adjusted under 35 U.S.C. 154(b) by 0 days.

(21) Appl. No.: 10/026,105

(22) Filed: Dec. 21, 2001

(65) Prior Publication Data

US 2002/0085922 A1 Jul. 4, 2002

Related U.S. Application Data

(63) Continuation-in-part of application No. 09/499,947, filed on Feb. 8, 2000, now abandoned.

(30) Foreign Application Priority Data

May 19, 1999 (IT) ..... MI990326 U

(51) Int. Cl.[7] ..... F04B 19/00; F04B 11/00
(52) U.S. Cl. ..... 417/68; 417/71
(58) Field of Search ..... 417/68, 71, 70

(56) References Cited

U.S. PATENT DOCUMENTS 4,392,783 A * 7/1983 Jozepaitis ..... 417/68
4,443,158 A * 4/1984 Bentele et al. ..... 417/68
4,756,672 A * 7/1988 Trimborn ..... 417/68
4,992,028 A * 2/1991 Schoenwald et al. ..... 417/68
5,489,195 A * 2/1996 Domagalla et al. ..... 417/68
5,647,728 A * 7/1997 Siebenwurst et al. ..... 417/68
5,800,146 A * 9/1998 Junemann et al. ..... 417/68

FOREIGN PATENT DOCUMENTS

GB 2064002 * 7/1981 ..... F04C/19/00

* cited by examiner

*Primary Examiner*—Charles G. Freay
*Assistant Examiner*—Timothy P. Solak
(74) *Attorney, Agent, or Firm*—Steinberg & Raskin, P.C.

(57) ABSTRACT

The liquid ring compressor comprises a cylindrical casing containing an impeller the axis of which is offset from the axis of the cylindrical casing. At least one end of the cylindrical casing is provided with a distribution plate and relative closure cover, the distribution plate comprising a suction aperture, a discharge aperture and a feed aperture for the operating liquid. The distribution plate is of small thickness and is constructed from sheet steel. The relative suction aperture and discharge aperture can have sharp edges and be obtained by -punching or by plasma or laser cutting.

13 Claims, 4 Drawing Sheets

LIQUID RING COMPRESSOR WITH THIN DISTRIBUTION PLATE

CROSS REFERENCE TO RELATED APPLICATION

The present application is a continuation-in-part application of U.S. patent application Ser. No. 09/499,947 filed on Feb. 8, 2000, now abandoned.

BACKGROUND OF THE INVENTION

This invention relates to liquid ring compressors, also known as liquid ring vacuum pumps.

Known liquid ring compressors consist of a substantially cylindrical casing within which an impeller provided with a plurality of blades can rotate. The axis of rotation of the impeller is parallel to the axis of the cylindrical casing but offset from it.

The cylindrical casing is closed at its two ends, at least one being closed by a removable distribution plate containing suction and discharge apertures for the intake gas, and the feed aperture for the operating liquid (usually water).

The distribution plate is maintained in position by a relative cover fixable to the cylindrical casing of the compressor to also form the connection between said suction and discharge apertures and the gas intake and discharge duct respectively.

Between that front surface of the impeller which faces the distribution plate and the corresponding surface of this latter there is a very small gap to provide a seal for the conveyed gas.

During the operation of such a compressor, the motor-driven impeller rotates the operating liquid which partly fills the cylindrical casing. Under the action of centrifugal force the operating liquid assumes the form of a ring (from which the liquid ring compressor derives its name) which is concentric with the cylindrical casing of the compressor.

During one complete revolution of the impeller shaft (one cycle) each pair of consecutive impeller blades cooperates with the surface of the formed liquid ring to define a chamber, known as the transport chamber, which varies in volume. During the initial 180 degree stage of the cycle, the blade immersion into the liquid ring gradually decreases, so that the volume of the transport chamber increases from zero to a maximum. During the final 180 degree stage of the cycle, the blade immersion into the liquid ring gradually increases, so that the volume of the transport chamber decreases from the maximum to zero. Consequently during the initial stage of the cycle, by connecting an individual transport-chamber for at least a part of said initial stage to the suction aperture provided in said distribution plate, gas is drawn in through the suction aperture, this having an appropriate shape. During the final stage of the cycle, by connecting an individual transport chamber to the discharge aperture, also provided in the distribution plate, the gas discharges through the discharge aperture, this also having an appropriate shape.

From the time of invention of liquid ring compressors (several decades ago) to the present-day, the relative distribution plates have been constructed of cast iron or stainless steel by casting followed by machining on a machine tool by chipping (turning).

Distribution plates constructed in this manner cannot however reliably and reppeatably achieve the geometrical tolerance required to ensure correct operation (high efficiency) of a compressor of this type. It has therefore been necessary in practice to use compromise design solutions which penalize the compressor performance, in order to achieve acceptable production costs.

Examining in greater detail the intrinsic limits of distribution plate construction by casting, it can be stated that:

a) the actual characteristics of the casting process and of the equipment used in it limit the designer in his choice of the most suitable shape and dimensions for the suction and discharge apertures;

b) even though attempting to reduce to a minimum the thickness of—distribution plates obtainable by casting, the thickness is still such as to require the formation of rounded edges or chutes for the suction and discharge apertures in order to achieve an acceptable outflow coefficient, this complicating the casting process and the equipment used in it;

c) because of the nature of the casting process itself, it is impossible to ensure that the suction and discharge apertures will have the correct position or shape.

Summarizing, besides not being able to guarantee that the distribution plate obtained has the correct geometry, the casting process is costly especially for stainless steel casting, and the subsequent machining of the distribution plate by machine tools is complicated and costly. In particular it is difficult to maintain within the required tolerance the planarity of that distribution plate surface facing the impeller, with the result that generally the gap between the impeller and distribution plate is greater than the ideal, with consequent penalization of the compressor performance, particularly during low pressure operation.

One attempt to overcome these drawbacks was to construct the distribution plates of ceramic. Although this solution gives good results in terms of aperture geometrical tolerance and plate planarity, it, is very costly. Moreover ceramic plates are delicate because of fragility, being subject to breakage both during compressor assembly and during compressor, operation, particularly if large temperature differences are present.

SUMMARY AND OBJECTS OF THE INVENTION

The object of the invention is to overcome the aforementioned drawbacks of known liquid ring compressors.

This object is attained by the liquid ring compressor of the invention, characterized in that the distribution plate (in the case of compressors with a single distribution plate) or the two distribution plates (in the case of compressors with two distribution plates) are plates of small thickness (compared with known plates) constructed from sheet steel.

As the plates are thin, the suction and discharge apertures can have sharp edges. These apertures can be formed by punching or by plasma or laser cutting.

The fact of using a thin steel sheet for constructing the distribution plates and of forming-the suction or discharge apertures by plasma or laser cutting or by punching ensures that the tolerances both of the planarity of that distribution plate surface facing the impeller and of the position and shape of the suction and discharge apertures fall within limits which do not appreciably penalize compressor performance, all at a lower cost than that of known liquid ring compressors. It should also be noted that by using the aforesaid cutting methods, apertures with very small radii of curvature can be formed in the distribution plates, so giving the designer total freedom in choosing the most suitable shapes for the suction and discharge apertures, and ensuring repeatability of the shape chosen for these apertures.

Moreover the use of plates of very thin sheet steel (up to a few millimeters) means that the suction and discharge apertures are of a thin wall type so that they do not require their edges to be of complex geometry as in the case of known cast plates, in which because of the significant plate thickness it becomes necessary to provide lead in roundings or chutes to ensure a good outflow coefficient for the apertures.

Planarity and stability of that plate surface facing the impeller is ensured by the intrinsic constancy of the thickness of the steel sheet from which the plate is formed, and by the planarity of the surface of the relative compressor front cover with which the distribution plate comes into contact. To obtain good distribution plate stability during compressor operation (so preventing any deformation perpendicular to the plate), the relative cover is adequately ribbed to adequately support the plate.

Conveniently the ratio of useful outer diameter of the distribution plate to its thickness is greater than 50.

BRIEF DESCRIPTION OF THE DRAWINGS

The invention will be better understood from the following description of one embodiment thereof. In this description reference is made to the accompanying drawings, on which.

DETAILED DESCRIPTION OF THE INVENTION

Figure 1:
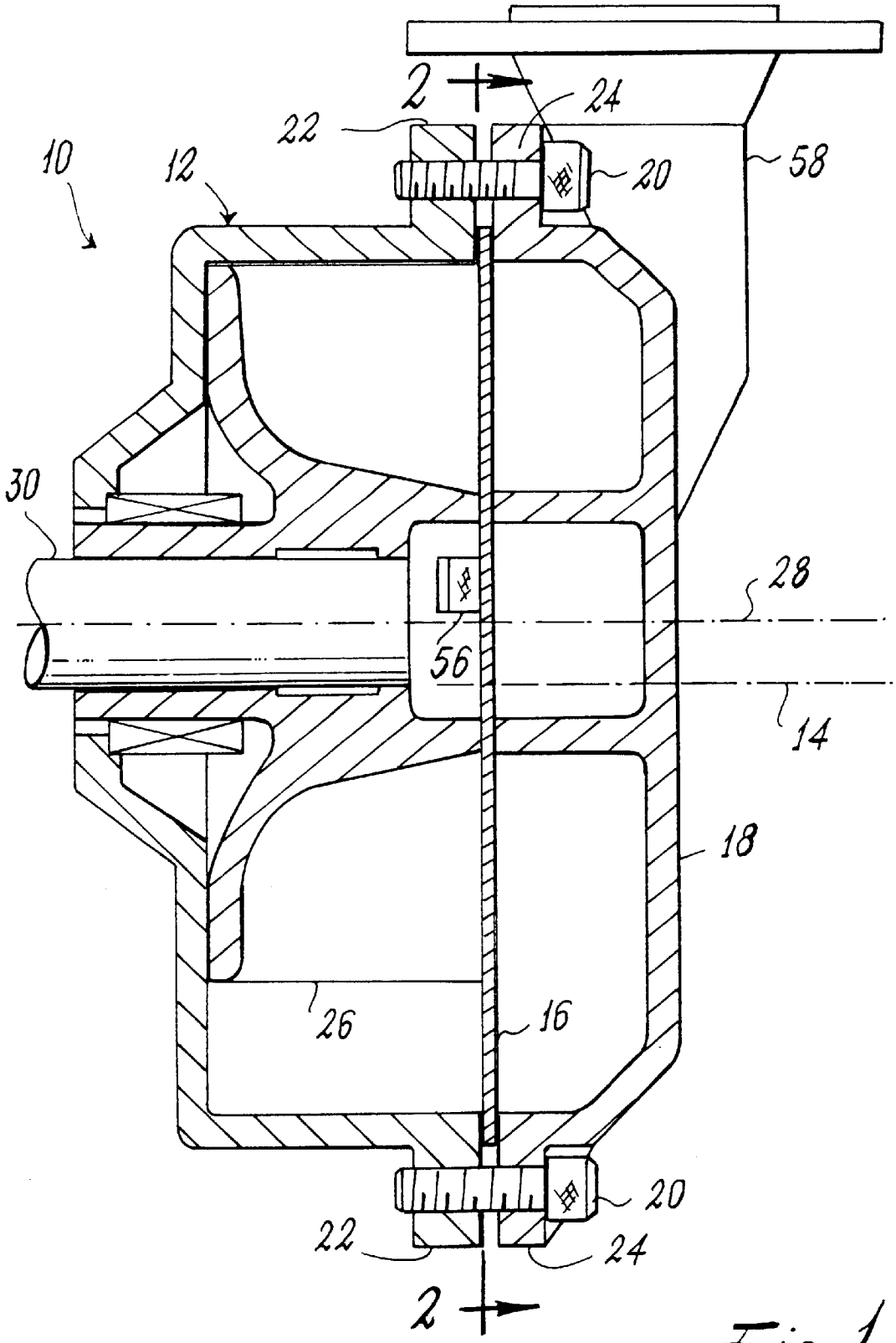
FIG. 1 is a longitudinal section through a liquid ring compressor of the single distribution plate type, the section being taken on a plane containing both the axis of rotation of the impeller and the axis of the cylindrical compressor casing.

From FIG. 1 it can be seen that the liquid ring compressor 10 comprises an overall cylindrical casing 12 of horizontal axis 14, and roughly of cup shape. One end of the cylindrical casing 12 (corresponding to the cup mouth) is closed by a distribution plate 16, best seen in FIG. 2, which is maintained in position by a front cover 18 fixed to the casing 12 by screws 20 (FIG. 1) screwable into relative holes provided in corresponding lugs 22 and 24 forming part of the casing 12 and cover 18 respectively. This latter also comprises the suction port 60 and the discharge port 58.

Within the cylindrical casing 12 there is provided an impeller 26 keyed onto a shaft 30. As can be seen in FIG. 1, the axis 28 of the shaft 30 is offset by an amount E from the axis 14 of the cylindrical casing 12.

For total understanding it must be emphasized that although the compressor 10 shown in the figures is of the single distribution plate type, the invention also covers compressors of the two distribution plate type, one for each of the two faces of the impeller, the two plates being maintained in position by a relative cover.

Figure 2:
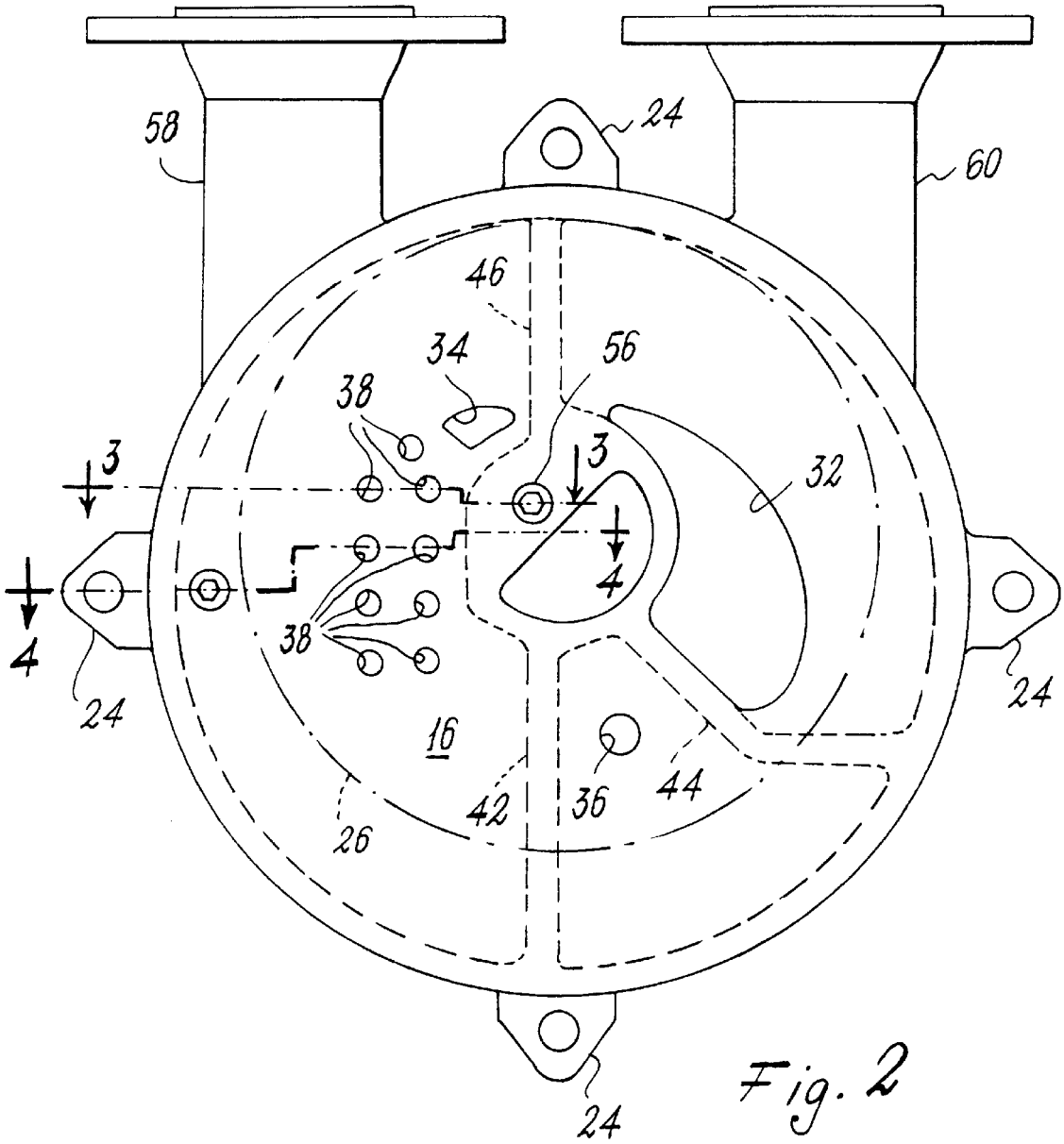
FIG. 2 is a cross-section therethrough on the line 2—2 of FIG. 1, showing that surface of the distribution plate facing the impeller.
Figure 3:
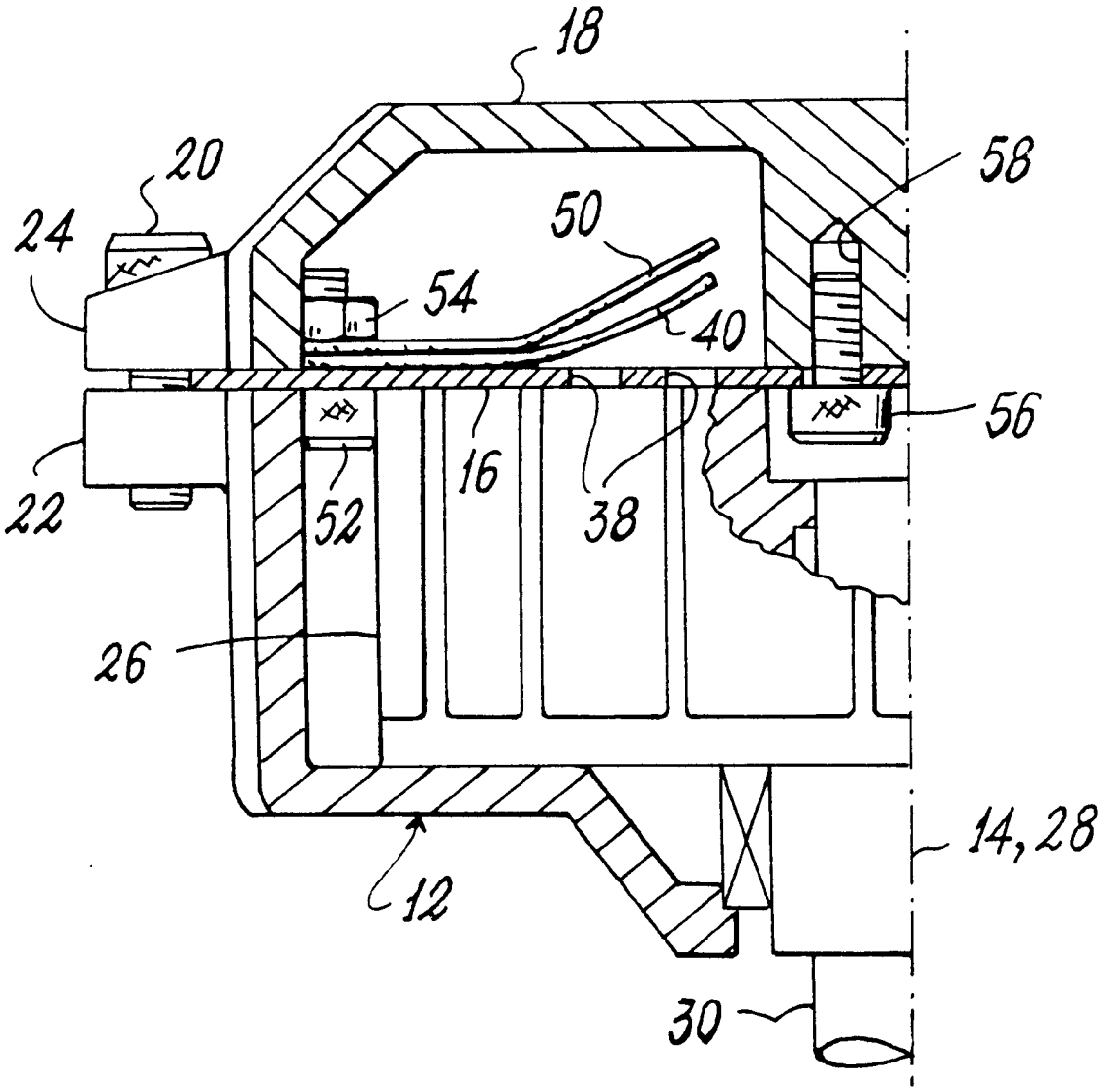
FIG. 3 is a partial cross-section therethrough on the line 3—3 of FIG. 2.
Figure 4:
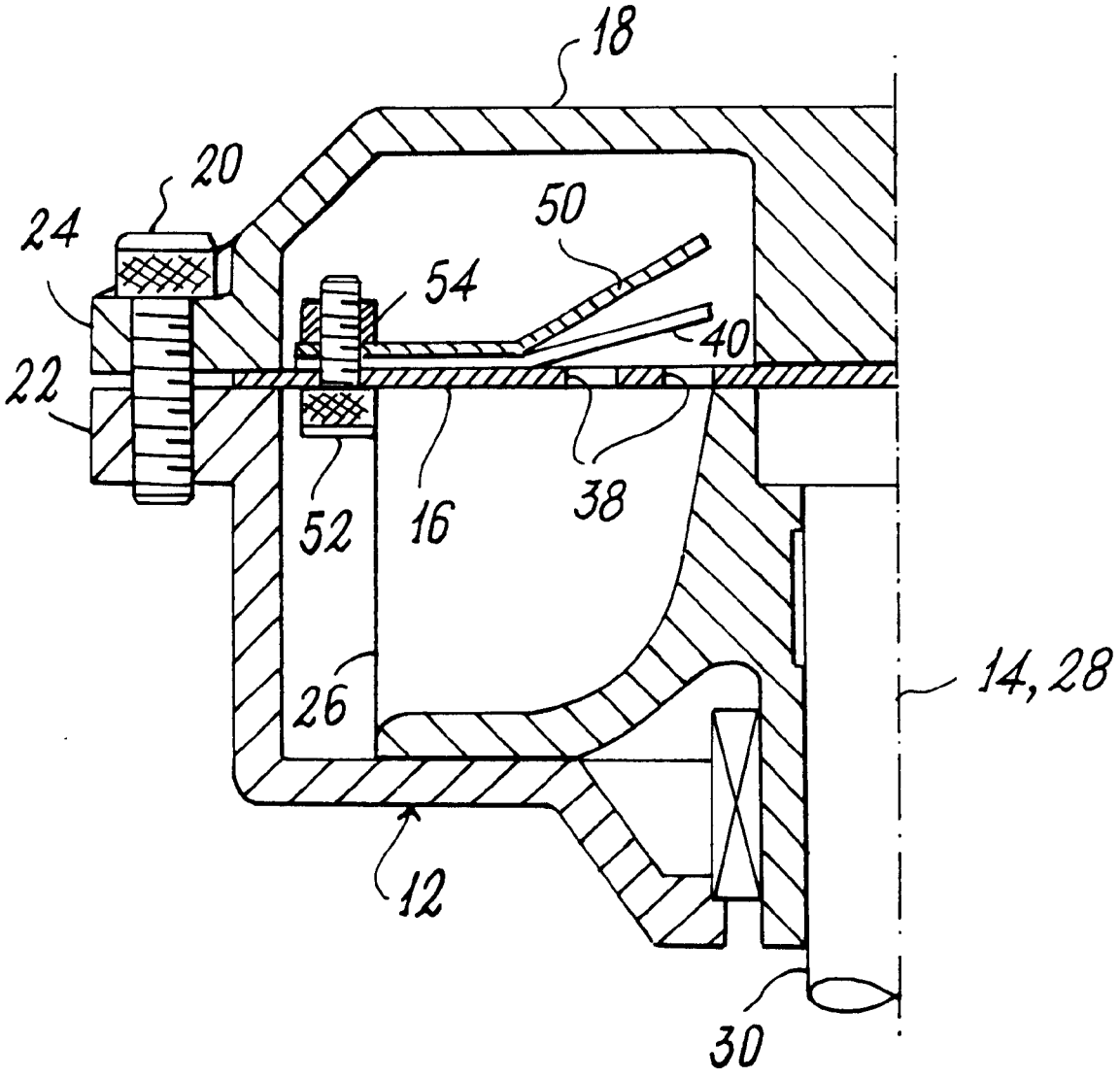
FIG. 4 is a partial cross-section therethrough on the line 4—4 of FIG. 2.

Returning to the compressor 10, FIG. 2 shows that surface of the distribution plate 16 facing the impeller 26, with the suction aperture 32, the terminal discharge aperture 34 and the feed aperture 36 for the operating liquid (by which said liquid ring is obtained). The nine circular holes indicated overall by 38 constitute the adjustable part of the discharge aperture, they being controllable by a non-return valve 40 provided on that side of the plate facing the cover 18 and visible in FIGS. 3 and 4. The non-return valve 40 enables the operation of the compressor 10 to be adapted to different suction pressures. The non-return valves 40 positioned on the discharge holes 38, and the relative valve presser 50, are fixed to the discharge plate 16 by one or more bolts 52 with nuts 54, inserted through respective holes provided in the plate 16 and lying outside the overall radial extent of the impeller such that this latter does not interfere with the bolts 52 (as can be seen in FIGS. 3 and 4). As an alternative, the non-return valve and relative valve presser can be fixed to the distribution plate by rivets.

As stated, the cover 18 comprises three support ribs 42, 44 and 46 for the plate 16, these being shown by dashed lines in FIG. 2 as they are covered by the plate 16. As can be seen, these ribs may also be non-radial (such as the rib 44 of FIG. 2). This figure also shows by a dashed and dotted line a circumference 26 eccentric to the axis 14 of the cylindrical casing 12 and defining the maximum dimensional extent of the impeller 26.

In the compressor 10 illustrated in the figures the distribution plate 16 is fixed to the cover 18 by the central screw 56 (visible in FIGS. 1–3) screwed into a relative threaded dead hole 58 (FIG. 3) provided in the cover 18.

However, rivets could be used for this purpose instead of the screw 56. With regard to the ratio of useful diameter of the distribution plate 16 to its thickness, it should be noted that, by way of example, this ratio is 63.5 in the illustrated case, i.e. greater than 50. Preferably the ratio of the useful diameter of the distribution plate to the thickness of said distribution plate 16 has a range of 50–70. Distribution plates normally have diameters ranging from about 100 to about 1000 mm.

What is claimed is:

1. A liquid ring compressor comprising:

a cylindrical casing having a first wall with an inner surface and an opposed second wall with an inner surface;

an impeller contained within said casing, an axis of said impeller being offset from an axis of the cylindrical casing;

a distribution plate having a useful diameter, a portion of said distribution plate being arranged between said inner surface of said first wall and said inner surface of said opposed second wall, said portion constituting said useful diameter of said distribution plate; and a relative closure cover provided at least on one end of the cylindrical casing, outside of said distribution plate, the distribution plate comprising a suction aperture, a discharge aperture and a feed aperture for passage of an operating liquid, wherein said suction aperture and said discharge aperture have sharp edges, and wherein a ratio of said useful diameter of said distribution plate to a thickness of said distribution plate is greater than 50, and wherein a plurality of ribs support and maintain said distribution plate planar.

2. A compressor as claimed in claim 1, wherein the suction aperture and discharge aperture are obtained by punching or by plasma or laser cutting.

3. A compressor as claimed in claim 1, wherein the compressor closure cover comprises ribs on which the distribution plate rests to achieve shape stability.

4. A compressor as claimed in claim 1, wherein the distribution plate is fixed to the closure cover by screws.

5. A compressor as claimed in claim 1, wherein the distribution plate is fixed to the closure cover by rivets.

6. A compressor as claimed in claim 1, wherein the discharge aperture is in the form of several holes, on some of these holes there being arranged a non-return valve, the non-return valve being fixed to the distribution plate by through bolts or rivets positioned outside the maximum dimensional extent of the impeller.

7. A compressor as claimed in claim 1, wherein said useful diameter of said distribution plate is from about 100 to about 1000 mm.

8. The compressor as claimed in claim 1, wherein said suction aperture and distribution aperture are planar and are flush with the surface of said distribution plate.

9. The compressor as claimed in claim 1, wherein said ratio of said useful diameter of said distribution plate to a thickness of said distribution plate is between 50–70.

10. The compressor as claimed in claim 1, wherein said ratio of said useful diameter of said distribution plate to a thickness of said distribution plate is between 50–80.

11. A liquid ring compressor comprising:

a cylindrical casing having a first wall with an inner surface and an opposed second wall with an inner surface;

an impeller contained within said casing, an axis of said impeller being offset from an axis of the cylindrical casing;

a planer distribution plate having a useful diameter, a portion of said distribution plate being arranged between said inner surface of said first wall and said inner surface of said opposed second wall, said portion constituting said useful diameter of said distribution plate; and a relative closure cover provided at least on one end of the cylindrical casing, outside of said distribution plate, said cover being structured and arranged for supporting and maintaining said distribution plate planar, the distribution plate comprising a suction aperture, a discharge aperture and a feed aperture for passage of an operating liquid, wherein said suction aperture and said discharge aperture have sharp edges, and wherein a ratio of said useful diameter of the distribution plate to a thickness of said distribution plate is greater than 50 and is constructed from sheet metal.

12. The compressor as claimed in claim 11, wherein said ratio of said useful diameter of said distribution plate to a thickness of said distribution plate is between 50–70.

13. The compressor as claimed in claim 11, wherein said ratio of said useful diameter of said distribution plate to a thickness of said distribution plate is between 50–80.

* * * * *

UNITED STATES PATENT AND TRADEMARK OFFICE

CERTIFICATE OF CORRECTION

PATENT NO. : 6,641,369 B2
DATED : November 4, 2003
INVENTOR(S) : Paolo Cavatorta It is certified that error appears in the above-identified patent and that said Letters Patent is hereby corrected as shown below:

Title page,
Item [75], the first name of the Inventor should be corrected to -- Paolo --

Signed and Sealed this

Fourth Day of May, 2004

JON W. DUDAS
*Acting Director of the United States Patent and Trademark Office*